United States Patent [19]

Smith

[11] Patent Number: 4,788,554

[45] Date of Patent: Nov. 29, 1988

[54] PLATED PLASTIC INJECTION MOLDED HORN FOR ANTENNA

[75] Inventor: Edward W. Smith, Los Angeles, Calif.

[73] Assignee: Satellite Technology Services, Inc., Maryland Heights, Mo.

[21] Appl. No.: 717,500

[22] Filed: Mar. 28, 1985

[51] Int. Cl.[4] ..... H01Q 13/00

[52] U.S. Cl. ..... 343/786; 343/916

[58] Field of Search ..... 343/786, 840, 912, 916

[56] References Cited

U.S. PATENT DOCUMENTS

| | | | |
|---|---|---|---|
| 2,416,675 | 3/1947 | Beck et al. | 343/786 |
| 3,320,341 | 5/1967 | Mackie | 343/786 |
| 4,356,495 | 10/1982 | Mörz | 343/786 |
| 4,358,770 | 11/1982 | Satoh et al. | 343/786 |
| 4,439,748 | 3/1984 | Dragone | 343/786 |

*Primary Examiner*—William L. Sikes
*Assistant Examiner*—Robert E. Wise
*Attorney, Agent, or Firm*—Rogers, Howell, Moore & Haferkamp

[57] ABSTRACT

An antenna horn of molded plastic construction. The horn may be constructed of multiple sections, each section being of molded plastic construction with the sections joined to form the horn.

29 Claims, 3 Drawing Sheets

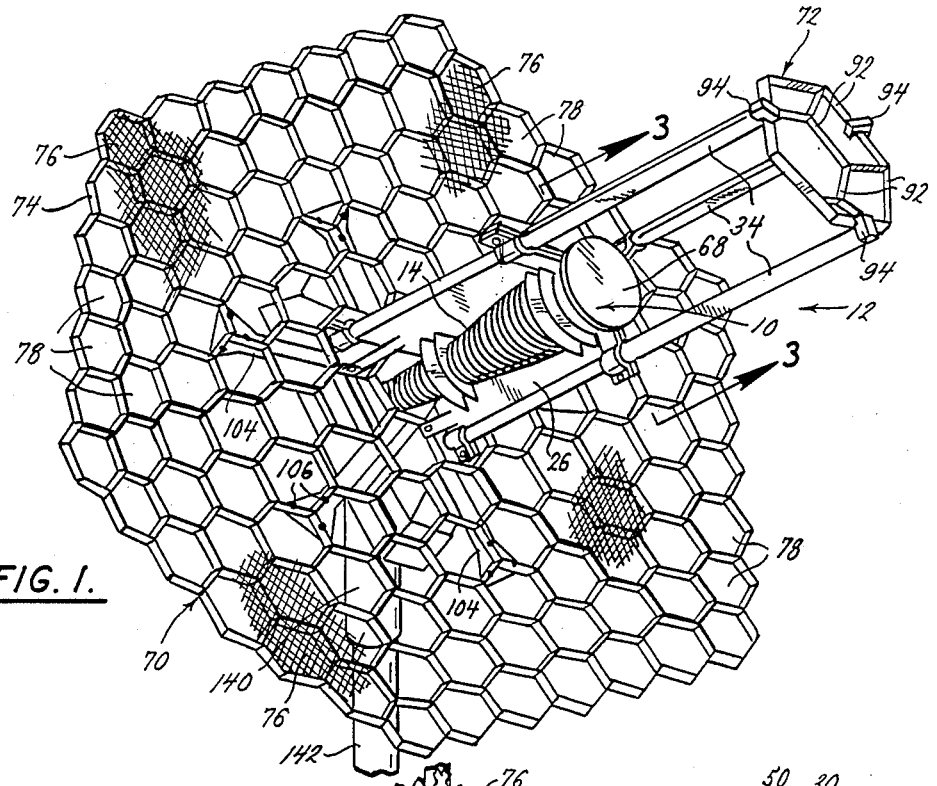
FIG. 1.
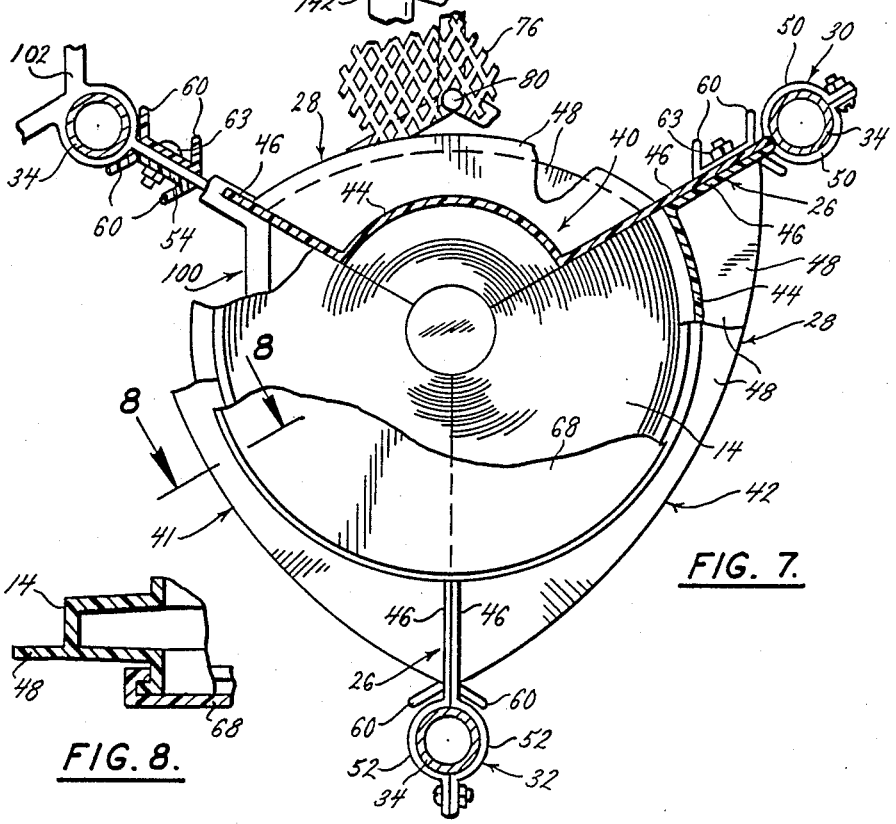
FIG. 7.
FIG. 8.

PLATED PLASTIC INJECTION MOLDED HORN FOR ANTENNA

BACKGROUND AND SUMMARY OF THE INVENTION

This invention relates to an antenna horn, and particularly such a horn that is of an injected molded plastic construction with the inner surface of an electromagnetic energy conductive material. The antenna horn of the present invention is particularly adapted for use with antennas of the Cassegrain type, and more particularly for a television receive only (TVRO) antenna.

Typically, TVRO antennas have been of the prime focus type. The highly sophisticated design techniques for Cassegrain antennas of a near field design have not heretofore been used in a TVRO antenna.

One of the problems associated with a Cassegrain antenna of a near field design is the cost. Such an antenna requires a sophisticated design to produce a compact Cassegrain antenna with high gain, high efficiency, low cross-polarization characteristics. Co-pending U.S. patent application entitled "Cassegrain Antenna for TVRO Application" filed concurrently herewith, the entirety of which is incorporated herein by reference, describes a TVRO Cassegrain antenna that achieves the aforementioned characteristics and does so at a relatively low cost. The present invention is directed to a horn that is particularly suited for the antenna of said co-pending application as its unique construction not only provides the desired electrical performance characteristics, but also is particularly suited to mass production techniques with low labor and material costs. While the horn of the present invention is particularly adapted for use with the antenna of said co-pending application, it is to be understood that many of the features of the horn are also suited for other horn designs and for use with other types of antennas.

Generally, the horn of the present invention is of a plastic molded construction with the inner surface of the horn being of an electromagnetic energy conductive material. More particularly, the horn is comprised of identical sections, each section being of molded plastic construction with the sections then joined such as by solvent welding to form the horn. The inner surface of the horn is plated, such as first with a coating of copper and then nickel, to provide the electromagnetic energy conductive surface. An outer weather-protective coating may also be applied.

In a particular adaptation of these features of the invention, the horn may be a corrugated, profiled horn which is circularly symmetric. Moreover, the horn may also include integrally molded plastic reinforcing and securing means for securing the horn to a mounting structure of the antenna with which it is to be used.

These and other features and advantages of the invention are apparent from the description to follow.

BRIEF DESCRIPTION OF THE DRAWINGS

FIG. 1 is a perspective view of a Cassegrain antenna having a horn of the present invention;

FIG. 7 is a view in section taken generally along the line 7—7 of FIG. 3;

FIG. 8 is a view in section taken generally along the line 8—8 of FIG. 7.

DETAILED DESCRIPTION OF THE PREFERRED EMBODIMENT

Figure 2:
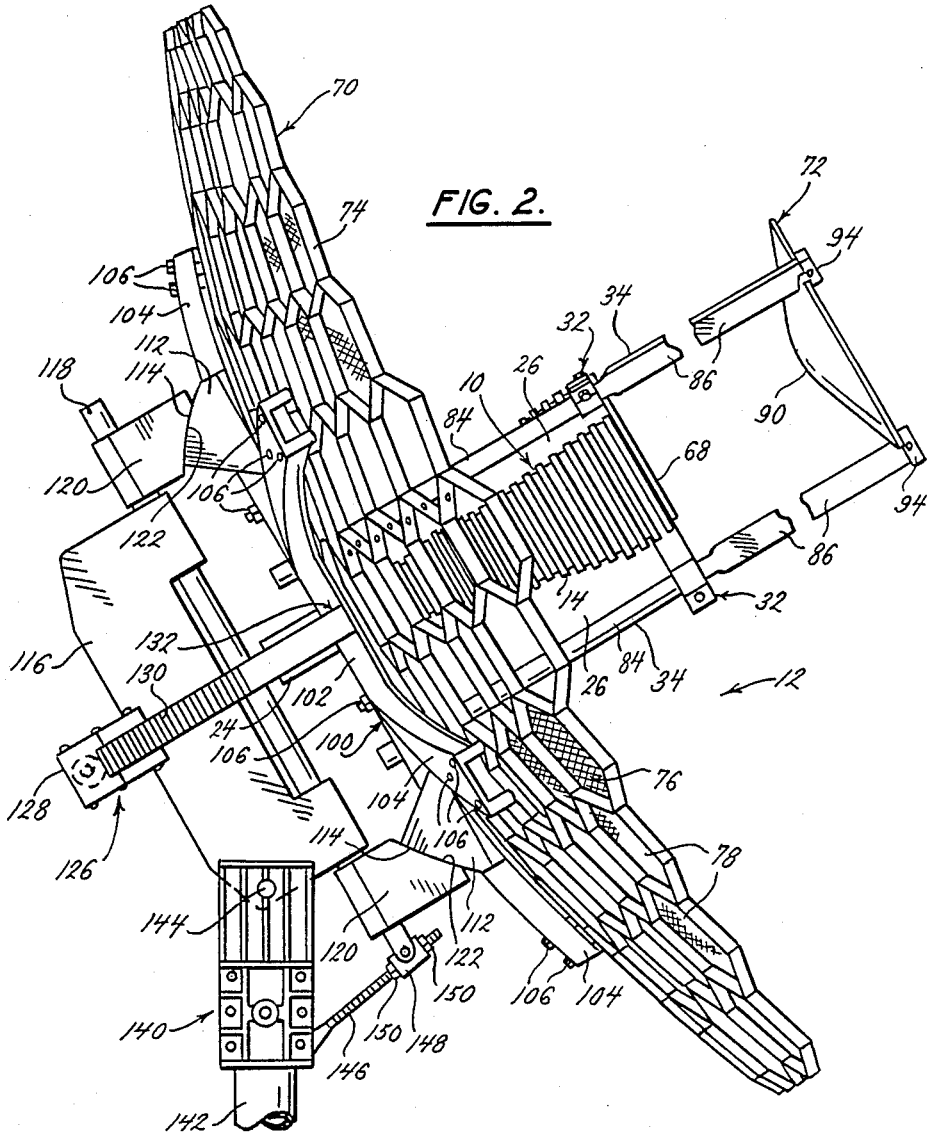
FIG. 2 is a side elevation view of the antenna of FIG. 1.

With reference to the drawing, there is shown an antenna horn 10 of the present invention. The horn 10 is shown in use with a true Cassegrain antenna 12 for which it is particularly designed. However, it is to be understood that in a broader sense the horn may be used with other types of antennas.

Figure 3:
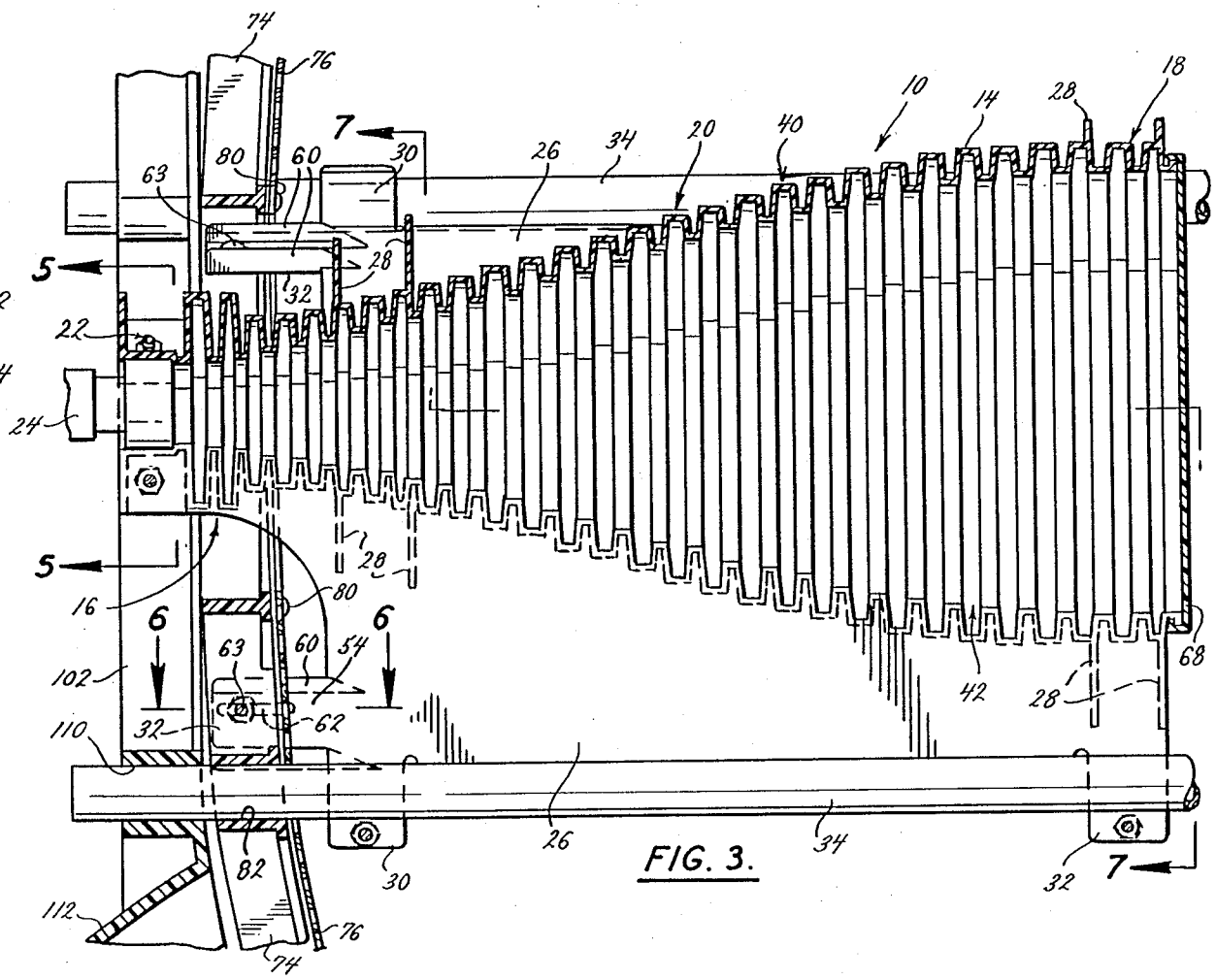
FIG. 3 is a view showing the horn and related antenna mounting structure generally in cross-section.

The horn is a corrugated, profiled horn. The body or wall 14 of the horn has a throat portion 16 and a mouth portion 18 of larger diameter than the throat, each of which are of stovepipe, or generally straight, configuration. Between the throat and mouth portions is a curved intermediate portion 20. The transitions between the throat, intermediate, and mouth portions are smooth such that the shape of the horn wall viewed in longitudinal cross-section as in FIG. 3 is generally S-shaped. The horn is circularly symmetric about its longitudinal axis and is corrugated as shown substantially along its entire length.

Figure 9:
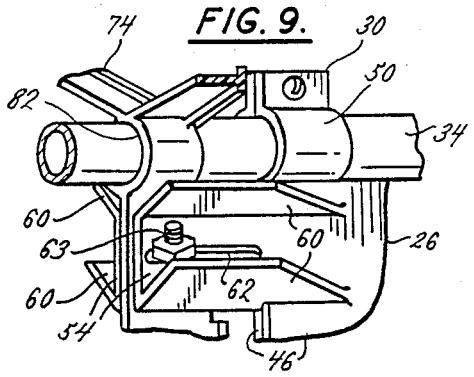
FIG. 9 is a perspective view of generally the upper left-hand portion of FIG. 3 to show the mounting of the horn to other antenna components.
Figure 6:
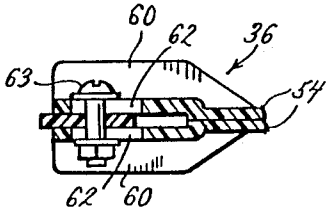
FIG. 6 is a view in section taken generally along the line 6—6 of FIG. 3.

At the throat end of the horn are wing clamps 22 for connecting a wave guide 24 or the like. The horn has equilaterally spaced radial webs 26 extending outwardly from the horn wall. Also near the throat and mouth of the horn are horizontal webs 28 and ring clamps 30 and 32 that clamp onto spars 34 to support the horn. The webs extend radially to the spars. The horn also includes rearwardly extending flanges 36 as best shown in FIGS. 3, 6, and 9, for connecting the horn to the superstructure of the main reflector as will be described.

The horn is made of three identical longitudinal sections 40, 41 and 42. Each section includes a wall portion 44 representing one-third of the wall or body of the horn. Each section also includes two radial web portions 46, each representing half a web 26. Each section also includes horizontal web portions 48 representing one-third of the horizontal webs 28. Each section also includes half ring portions 50 extending outwardly from the webs near the throat of the horn and representing half the ring clamps 30, and half ring portions 52 extending outwardly from the webs near the mouth of the horn and representing half the ring clamps 32. Each section further includes half flange portions 54 extending rearwardly from the web and each representing half a flange 36. Each flange portion has reinforcing ribs 60 and an elongated slot 62 to allow axial adjustment of the horn. Fasteners 63 extend through the slots to secure the horn to the superstructure of the main reflector. Each horn section also includes ears 64 each representing half a wing clamp 22.

Each horn section including the wall portion, half-web portions, half-ring portions, half-flange portions, and ears, is of one piece molded plastic construction. The three sections are joined, such as by solvent welding, to form the horn.

Figure 4:
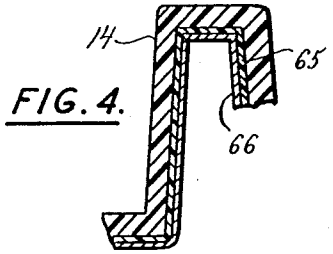
FIG. 4 is an enlarged view showing a typical corrugation in the horn wall.
Figure 5:
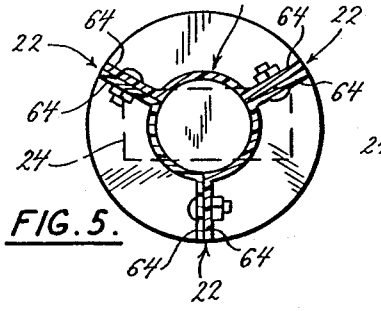
FIG. 5 is a view in section taken generally along the line 5—5 of FIG. 3.

The inner surface of the horn is of an electromagnetic conductive material which may comprise a first plated coating 65 of copper followed by a second plated coating 66 of nickel. These coatings may be forty-millionths and ten-millionths, respectively. Preferably, the electromagnetic energy conductive coatings are applied to each section before the horn sections are joined. The horn may be painted with a weather-protective coating such as polyurethane. FIG. 4 is a cross-section through the wall of the horn showing a typical corrugation with the copper and nickel coatings. The horn has a weather cap 68 of an electromagnetic energy transparent material.

The antenna 12 with which the horn 10 of this invention may be used, may be a true Cassegrain antenna. In addition to the horn 10, the antenna includes a main reflector 70 and a subreflector 72. The main reflector 70 includes a superstructure 74 with a mesh covering 76 on the reflective side thereof (FIGS. 1, 3, and 7). The superstructure 74 is of a honeycomb configuration having a large number of openings 78 of a hexagonal shape. The main reflector is smoothly shaped with a hexagonal perimeter as shown in FIGS. 1 and 2.

The mesh covering 76 is of a die-cut aluminum, flattened, and powder coated and with a weather protective coating of polyester. The mesh covering is attached to the superstructure by suitable fasteners 80.

The spars of rods 34 support the subreflector and horn. There are three equilaterally spaced spars that extend from within openings 82 in the superstructure and forwardly at the reflective side of the main reflector. Each spar has a round portion 84 and an outer flattened portion 86. At the outer ends of the spars is mounted the subreflector 72. The subreflector 72 is of one-piece plastic molded construction having a smoothly shaped reflective surface 90 facing the main reflector with reinforcing ribs 92 at the side of the subreflector opposite the reflective surface. The subreflector includes cap portions 94 that fit over the ends of the spars and are attached thereto for mounting the subreflector at the outer end of the spars and spaced away from the main reflector. The spars may be of aluminum. The reflective surface 90 of the subreflector is coated with an electromagnetic energy reflective material which may be first and second coatings of copper and nickel, forty-millionths and ten-millionths, respectively.

The horn extends through the center of the main reflector toward the subreflector with the mouth of the horn facing the reflective surface 90 of the subreflector. The ring clamps 30 and 32 of the horn are attached to the spars, and the flanges 36 of the horn are attached to the superstructure 74 of the main reflector. It should be noted that the horn being clamped to the spars helps to stabilize the spars and hence strengthen and stabilize the reflector support, all within the shadow of the subreflector for minimal blockage.

The main reflector, subreflector, and horn are supported by a spider 100 secured to the non-reflective side of the main reflector. The spider has a central portion 102 with a hexagonal opening therein, and radial arms 104 extending outwardly therefrom. The spider has a shape that conforms to that of the superstructure. The superstructure is mounted to the spider by means of fasteners 106 which extend through holes in the spider and superstructure. The spars 34 extend through openings 110 in the spider. The spider has portions 112 with arcuate surfaces 114 to define a track for declination adjustment.

A generally U-shaped connector 116 is located rearwardly of the spider and has a pivot pin 118 extending therethrough. Mounted on the pivot pin outwardly of each end of the U-connector is a spider pad 120. These spider pads have arcuate surfaces 122 that mate with the arcuate surfaces 114.

At the rear side of the U-connector 116 is an azimuth drive assembly 126 including a worm drive and housing 128, the housing of which captures the U-connector 116, and an annular gear track 130 surrounding the U-connector with the ends of the track mounted at 132 to the central portion of the spider. Thus, the combination of the annular track and worm drive housing hold the U-connector and spider pads in place so that the arcuate surfaces 122 of the spider pads engage the arcuate surfaces 114 of the spider.

A pivot yoke 140 is mounted at the upper end of a mast 142 with the top of the yoke pivotally mounted at 144 near the bottom of the U-connector and rearwardly of the pivot pin 118. A threaded rod 146 extends through a sleeve 148 pivotally mounted at the bottom of the pin 118 with the end of the threaded rod pivotally connected near the lower end of the yoke. Suitable adjusting nuts 150 allow adjustment of the threaded rod to provide an elevation adjust for the antenna. Azimuth adjust is provided by the drive 126 which pivots the spider and all the components mounted thereto, as well as the spider pads, about the axis of the pin 118. Declination adjustment is provided by positioning the spider relative to the spider pads along the arcuate surfaces.

Thus, it can be seen that the horn is held in a selected axial position by the fasteners 63, and the subreflector is held in a selected axial position by the fact that it is mounted to the spars 34 which in turn are held in a fixed axial position by the horn which is clamped to the spars. Hence, the horn and subreflector may each be axially adjusted independently of the other. Once the horn is properly positioned, the subreflector may be positioned by loosening the clamps 30 and 32 and sliding the spars in or out as desired of the openings 82 and 110 in the superstructure and spider.

Thus, the antenna horn of this invention is particularly adapted for mass production to provide a low cost horn. While it is designed primarily as a TVRO antenna horn, and more particularly, for use with a C-band antenna, certainly its unique design features offer significant advantages for other uses and at other frequency bands. The corrugations and shaping of the horn provide substantially equal E and H plane feed patterns over a broad bandwidth at a low VSWR, and allows for a compact design placing the near field focal point, and hence the subreflector, closer to the main reflector. The horn configuration also has low cross polarization, and a good spherical phase pattern down to a low energy level. These desirable performance characteristics are maintained while at the same time providing a low cost horn.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

What is claimed is:

1. An antenna horn, said horn being corrugated and profiled such that the wall of said horn in longitudinal cross section is generally S-shaped and constructed of multiple identical sections, each section of plastic molded construction, said sections joined to form the horn, and said horn having an internal surface of an electromagnetic energy conductive material.

2. The antenna horn of claim 1 wherein the internal surface of said horn has an inner coating of copper and a second coating of nickel.

3. The antenna horn of claim 1 wherein said horn is a TVRO antenna horn.

4. The antenna horn of claim 3 wherein said horn is a C-band horn.

5. The antenna horn of claim 1 wherein said horn is circularly symmetric.

6. The antenna horn of claim 5 wherein said horn provides generally an equal E and H plane feed pattern at the frequency band for which it is designed.

7. The antenna horn of claim 5 wherein said horn has corrugated straight portions at the throat and mouth ends thereof with a corrugated intermediate portion therebetween, the straight portion at the mouth of the horn being of larger diameter than that at the throat of the horn, the transition between said throat, intermediate, and mouth portions being smooth such that the shape of the horn in longitudinal cross-section through all portions is generally S-shaped.

8. The antenna horn of claim 1 wherein the corrugations of said horn are concentric and extend generally the full length of the horn.

9. The antenna horn of claim 1 wherein said horn has radial, integrally molded, outwardly extending plastic webs, and integrally plastic molded means for securing said horn to a mounting structure of an antenna.

10. The antenna horn of claim 9 wherein said integrally molded securing means further comprises integrally molded plastic ring clamps extending from said webs.

11. The antenna horn of claim 10 wherein said integrally molded securing means further comprises integrally molded plastic flanges extending from said webs.

12. The antenna horn of claim 1 wherein said horn has an outer weather protective coating.

13. The antenna horn of claim 12 further comprising an electromagnetic energy transparent weather cap covering the mouth of said horn.

14. The antenna horn of claim 1 wherein said horn is circularly symetric with corrugations extending generally the full length of the horn, each corrugation being continuous about the circumference of the horn.

15. An antenna horn, said horn being constructed of multiple identical sections, each section of plastic molded construction, said sections joined to form the horn, said horn having an internal surface of an electromagnetic energy conductive material, and said horn further having radial integrally molded, outwardly extending plastic webs, and integrally plastic molded means for securing said horn to a mounting structure of an antenna.

16. The antenna horn of claim 15 wherein said horn is circularly symmetric.

17. The antenna horn of claim 15 wherein said horn has an outer weather protective coating.

18. The antenna horn of claim 15 wherein said integrally molded securing means further comprises integrally molded plastic ring clamps extending from said webs.

19. The antenna horn of claim 15 wherein said integrally molded securing means further comprises integrally molded plastic flanges extending from said webs.

20. The antenna horn of claim 15 wherein said horn has a corrugated wall with the corrugations extending generally the full length of the horn, each corrugation being continuous about the wall of the horn at any cross-sectional location along the length of the horn.

21. An antenna horn, said horn being corrugated and profiled, and being circularly symmetric, said corrugations extending substantially the full length of the horn, said profile being such that the wall of said horn in longitudinal cross-section is generally S-shaped, said horn being constructed of multiple identical sections, each section of plastic molded construction, said sections joined to form the horn.

22. The antenna horn of claim 21 wherein said horn has radial, integrally molded, outwardly extending plastic webs and integrally plastic molded means for securing said horn to a mounting structure of an antenna.

23. The antenna horn of claim 22 wherein said integrally molded securing means further comprises integrally molded plastic ring clamps extending from said webs.

24. The antenna horn of claim 22 wherein said integrally molded securing means further comprises integrally molded plastic flanges extending from said webs.

25. The antenna horn of claim 22 wherein each section of said horn has radial, integrally molded, outwardly extending plastic web portions, that combine with identical web portions of adjacent horn sections to comprise said webs.

26. The antenna horn of claim 25 wherein each horn section has integrally molded plastic ring portions extending from said web portions and which combine with identical ring portions of adjacent horn sections to comprise ring clamps for securing said horn to a mounting structure of an antenna.

27. An antenna horn, said horn being corrugated and profiled and constructed of multiple identical sections, each section of plastic molded construction, said sections joined to form the horn, said horn having an internal surface of a electromagnetic energy conductive material, and said horn further having radial integrally molded, outwardly extending plastic webs, and integrally plastic molded means for securing said horn to a mounting structure of an antenna.

28. The antenna horn of claim 27 wherein said integrally molded securing means further comprises integrally molded plastic ring clamps extending from said webs.

29. The antenna horn of claim 28 wherein said integrally molded securing means further comprises integrally molded plastic flanges extending from said webs.

* * * * *